US009296003B2

(12) United States Patent
Zavarella et al.

(10) Patent No.: US 9,296,003 B2
(45) Date of Patent: Mar. 29, 2016

(54) DISPENSING PUMP

(71) Applicant: EMSAR S.p.A., San Giovanni Teatino (CH) (IT)

(72) Inventors: Marco Zavarella, Sulmona (IT); Matteo Caporale, Pescara (IT)

(73) Assignee: APTAR ITALIA S.P.A., San Giovanni Teatino (CH) (IT)

( * ) Notice: Subject to any disclaimer, the term of this patent is extended or adjusted under 35 U.S.C. 154(b) by 37 days.

(21) Appl. No.: 14/190,233

(22) Filed: Feb. 26, 2014

(65) Prior Publication Data

US 2015/0238989 A1 Aug. 27, 2015

(51) Int. Cl.
*B05B 11/00* (2006.01)

(52) U.S. Cl.
CPC ..... *B05B 11/3098* (2013.01); *B05B 11/0016* (2013.01); *B05B 11/3001* (2013.01); *B05B 11/3002* (2013.01); *B05B 11/305* (2013.01); *B05B 11/306* (2013.01); *B05B 11/3023* (2013.01); *B05B 11/3047* (2013.01); *B05B 11/3074* (2013.01)

(58) Field of Classification Search
CPC ..... B05B 11/3098; B05B 11/3001; B05B 11/3047
USPC ..... 222/321.1, 321.6–321.9, 383.1, 383.3
See application file for complete search history.

(56) References Cited

U.S. PATENT DOCUMENTS

| | | | | | |
|---|---|---|---|---|---|
| 3,159,316 | A | * | 12/1964 | O'Dounell et al. | 222/321.9 |
| 3,211,346 | A | * | 10/1965 | Meshberg | 222/321.9 |
| 3,228,571 | A | * | 1/1966 | O'Donnell et al. | 222/321.9 |
| 3,877,616 | A | * | 4/1975 | Stevens | 222/321.9 |
| 3,949,910 | A | * | 4/1976 | Focht | 222/321.9 |
| 6,702,157 | B1 | * | 3/2004 | Dobbs | 222/321.7 |
| 2011/0174840 | A1 | * | 7/2011 | Law et al. | 222/153.13 |

FOREIGN PATENT DOCUMENTS

| | | | |
|---|---|---|---|
| EP | 0990595 | A | 4/2000 |
| WO | 2011/074024 | A1 | 6/2011 |

* cited by examiner

*Primary Examiner* — Donnell Long
(74) *Attorney, Agent, or Firm* — Young & Thompson

(57) ABSTRACT

A dispensing pump includes a housing extending along a longitudinal axis and configured to be inserted in a bottle. The housing defines a dosing chamber and includes a venting hole. A retaining ring is fastened to the housing and inserted therein. A hollow stem is associated to a piston and inserted in a hole of the retaining ring leaving a passage. The hollow stem and piston are movable between a lowered position and a raised position corresponding to different volumes of the dosing chamber. A venting path includes at least the passage between the hollow stem and the retaining ring and the venting hole. Through the venting path a volume of air enters the bottle through the venting hole during the pump actuation to replace liquid pumped out from the bottle by the pump. A venting valve is interposed between the hollow stem and retaining ring, along the venting path.

16 Claims, 5 Drawing Sheets

DISPENSING PUMP

TECHNICAL FIELD

The present invention relates to a dispensing pump, i.e. to a pump of a dispenser or dosing device able to be applied to the neck of a bottle to dispense the liquid contained therein.

BACKGROUND ART

In order to dispense a liquid contained in a bottle it is known to use a so called "lock down" dispensing pump which, when applied to the bottle and put on the market, is in a down-locked position.

In particular "atmospheric" dispensing pumps the housing of the dispensing pump has on its side a venting hole which function is to permit the venting, i.e. the admission of the air in the bottle. In particular during the pump actuation a volume of air enters into the bottle through the venting hole, in order to replace the liquid pumped out from the bottle by the pump.

A dispensing pump of this type is known for example from EP0990595 or WO2011/074024. When this dispensing pump is in its down-locked position, that is the condition in which the dispensing pump is supposed to be applied to the bottle and put on the market, the liquid contained into the bottle can be accumulated in some areas of the venting path. For example, with reference to the patent WO2011/074024, the housing could be filled in the area upon the piston by a certain amount of liquid that could flow through the venting hole of the housing during transportation. No preventing systems are normally considered.

So, once the dispensing pump is opened the first time, the piston pushes up this amount of liquid, so forcing it to flow out through the venting passages existing between the retaining ring and the hollow stem of the dispensing pump. The liquid can therefore go in touch with the metal spring, with a potential risk of corrosion, or even flow outside the dispensing pump, so creating unaesthetic problems, contamination of the liquid and mess.

Furthermore, the liquid that leaks out of the venting passages and stops there for a while, could also dry and clog the venting passages.

DISCLOSURE OF THE INVENTION

In this context, the technical task at the basis of the present invention is to propose a dispensing pump that overcomes the aforementioned drawbacks of the prior art.

In particular, an object of the present invention is to make available a dispensing pump suitable for avoiding leakage of liquid through the venting path without influencing the working phase during every stroke of the hollow stem.

Moreover, an object of the present invention is to make available a dispensing pump that is structurally simple and enabling a simple and effective assembly.

Lastly, an object of the present invention is to provide a dispensing pump that has contained dimensions, that is light to use and economical to manufacture.

The specified technical task and the objects set out above are substantially achieved by a dispensing pump, comprising the technical characteristics exposed in one or more of the appended claims. Dependent claims relates to further amendments of the invention.

BRIEF DESCRIPTION OF DRAWINGS

Further characteristics and advantages of the present invention shall become more readily apparent from the indicative, and therefore not limiting, description of a preferred but not exclusive embodiment of a dispensing pump, as illustrated in the accompanying drawings in which.

DETAILED DESCRIPTION OF PREFERRED EMBODIMENTS OF THE INVENTION

Figure 1:
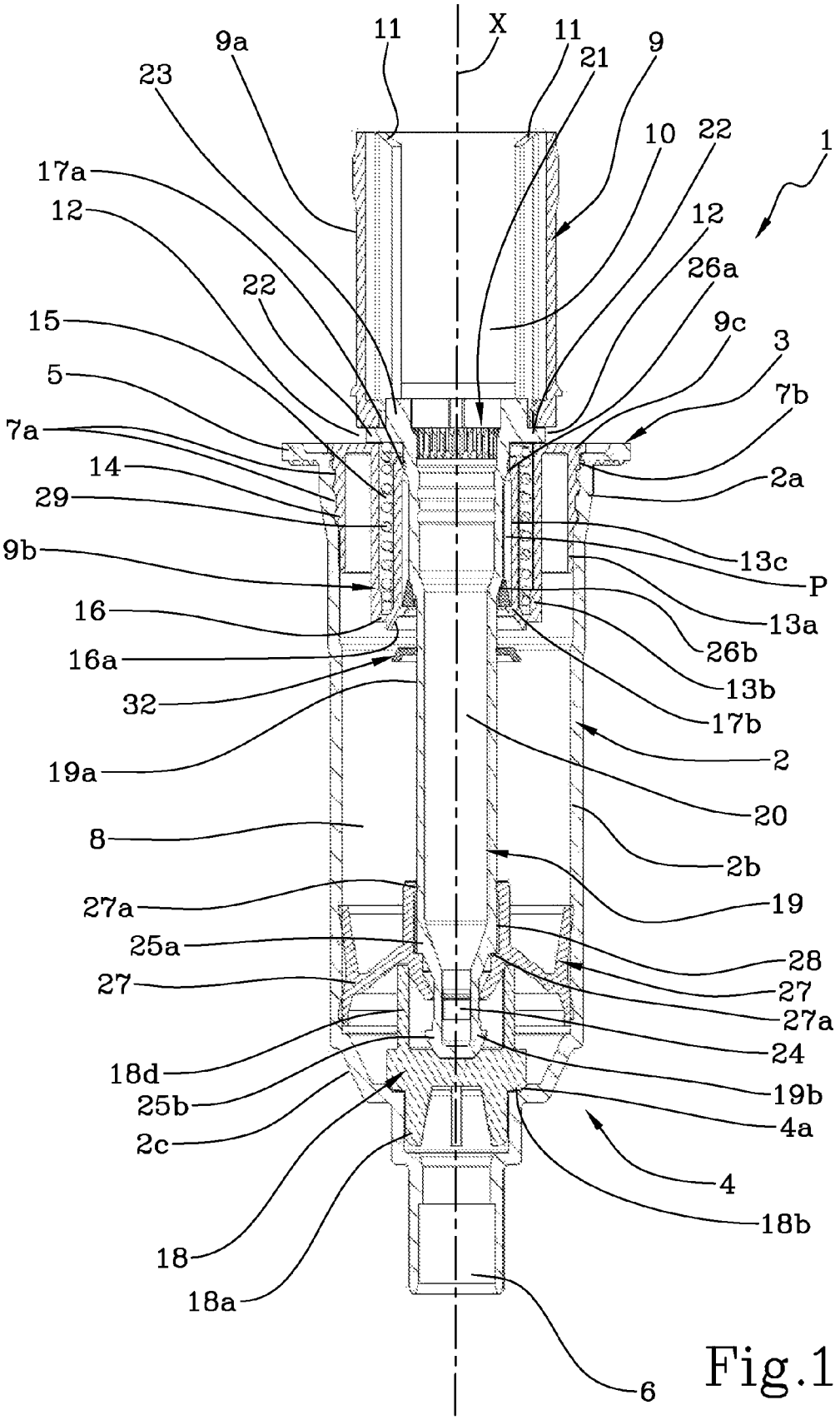
FIG. 1 is a sectioned view of a dispensing pump in accordance with the present invention in a down-locked configuration.

With reference to the accompanying drawings, a dispensing pump in accordance with the present invention is indicated with the number 1. The dispensing pump can be fastened to a ring nut (not shown) able to be screwed onto the neck of the bottle.

The dispensing pump 1 comprises a housing 2 in the form of a hollow containment body extending along a longitudinal axis X, able to be inserted in a bottle (not shown). The dispensing pump 1 is disclosed with reference to its working position that is when the longitudinal axis X is vertical. Terms like "upper" or "lower" and similar are used with reference to the working position of the dispensing pump corresponding the position shown in the figures.

The housing 2 has axial-symmetric geometry and it comprises a top portion 3 and a bottom portion 4, having geometries with different diameter.

The housing 2 presents substantially funnel-like geometry.

The upper portion 3 of the housing 2 is open and its function is to enable the insertion into the housing 2 of the elements (described farther on) forming the dispensing pump 1. Preferably the housing 2 comprises an annular lip 5 positioned in the upper portion 3 of the housing 2 and surrounding the upper opening of the housing 2. The annular lip 5 is configured to rest on the neck of the bottle. Preferably a gasket is positioned between the annular lip 5 and the edge of the neck of the bottle.

The bottom portion 4 is provided with an orifice 6 through which the liquid contained in the bottle enters the housing 2. Preferably the orifice 6 is connected with an interference to a dip tube (not shown).

In particular, the housing 2 comprises a first section 2*a* that develops starting from the upper portion 3 towards the bottom portion 4, and a second section 2*b* positioned underneath the first section 2*a*.

The first section 2*a* internally comprises undercuts 7*a* and an anti-rotation system 7*b*.

The second section 2*b* defines a dosing chamber 8 for the dispensing pump 1.

Underneath the dosing chamber 8 develops a third section 2*c* of the housing 2 from which the orifice 6 extends. The three aforementioned sections 2*a*-2*c* have mutually different transverse dimensions, in such a way as to define the aforesaid funnel configuration of the housing 2.

In particular, the second section 2*b*, the one defining the dosing chamber 8, is substantially cylindrical.

The dispensing pump 1 comprises a retaining ring 9 fastened to the housing 2 and inserted therein. The retaining ring 9 is positioned in the first section 2*a* of the housing 2 and it has a hole 10.

The retaining ring 9 has a substantial axial-symmetric geometry with reference to the longitudinal axis X.

The retaining ring 9 presents an upper portion 9*a* and a lower portion 9*b* delimited by a flange 9*c*. The upper portion 9*a* is configured as an upper skirt comprising at least two vertical guides 11 which project radially within the hole 10.

Moreover, the retaining ring 9 presents internally, at the base of the vertical guides 11, at least two down-locking undercuts 12, positioned at diametrically opposite sides.

Preferably the retaining ring 9 comprises, in the lower portion 9*b*, an outer skirt 13*a*, an intermediate skirt 13*b* and an inner skirt 13*c*. The outer skirt 13*a*, the intermediate skirt 13*b* and the inner skirt 13*c* are coaxial and have different diameters with respect to the longitudinal axis X. The outer skirt 13*a* comprises undercuts 14 configured to cooperate with undercuts 7*a* of the first section 2*a*. Moreover the outer skirt 13*a* houses the anti-rotational system 7*b* of the first section 2*a*. When the retaining ring 9 is inserted axially within the housing, the outer skirt 13*a* of the retaining ring 9 and the first section 2*a* of the housing 2 cooperate to mutually fasten the retaining ring 9 and the housing 2 preventing their axial detachment and a relative rotation around the longitudinal axis X.

An annular seat 15 is defined between the intermediate skirt 13*b* and the inner skirt 13*c*. The intermediate skirt 13*b* and the inner skirt 13*c* are connected by means of a base 16 closing the annular seat 15 on the side of the dosing chamber 8. The base 16 comprises a conical seat 16*a* on the side of the dosing chamber 8.

The inner skirt 13*c* comprises an upper annular projection 17*a* and a lower annular projection 17*b* which project radially within the hole 10.

A inlet valve 18 appropriately positioned inside the housing 2 at the base of the bottom portion 4 opens and shuts the orifice 6 in manners clarified further on. In particular the inlet valve 18 slides axially within the housing 2 between a closed and an open configuration of the orifice 6. Preferably the inlet valve 18 comprises a plug 18*a* formed by ribs (preferably four ribs) configured to keep the inlet valve on the axis when sliding. The inlet valve comprises a flat surface 18*b* which couples with a flat surface 4*a* on the bottom portion 4 of the housing 2 to guarantee the sealing in lock position and in use.

Figure 2:
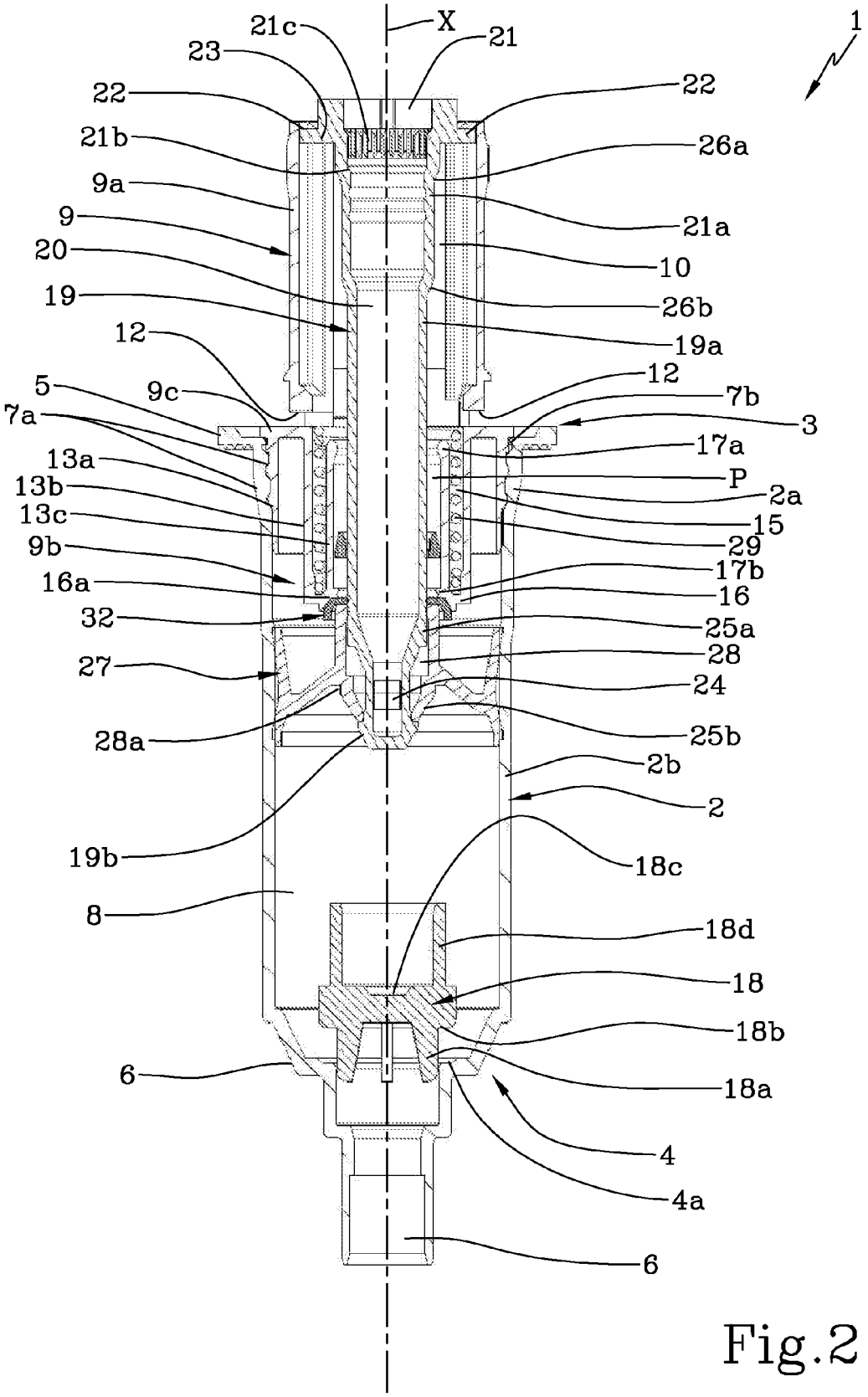
FIG. 2 shows the dispensing pump of FIG. 1 in a raised configuration.

According to an embodiment, the upper part of the inlet valve comprises a shaped surface 18*c* (FIG. 2) surrounded by an annular wall 18*d*.

The dispensing pump 1 comprises a hollow stem 19 extending along the longitudinal axis X. When assembled within the housing 2, in particular within the retaining ring 9, the hollow stem 19 is arranged along the longitudinal axis X and is able to slide axially within the housing 2 between a raised position (FIG. 2) and a lowered position (FIG. 1). In particular the hollow stem 19 is able to slide axially within the hole 10 of the retaining ring 9 and is guided by means of the upper portion 9*a* and of the inner skirt 13*c*.

The hollow stem 19 comprises an upper tubular part 19*a* and a lower head 19*b*.

The upper tubular part 19*a* defines a channel 20 configured to transfer the liquid present inside the dosing chamber 8 to a dispensing device, for example a dispensing spout (not shown), that dispenses the liquid outside the bottle.

Preferably the upper tubular 19*a* part of hollow stem 19 is connected with the dispensing device allowing the liquid inside the channel 20 to be transferred outside the dispensing pump. More preferably the upper tubular 19*a* part of hollow stem 19 defines, preferably within the channel 20, a receiving seat 21 configured to receive a connecting portion of the dispensing device (not shown). In particular the receiving seat 21 comprises at least one between:

- undercuts 21*a* to ensure retention of the dispensing device;
- a sealing portion 21*b* configured to cooperate with the dispensing device;
- an anti-rotational system 21*c*.

The upper tubular part 19*a* of the hollow stem 19 comprises sliding fins 22, which project radially from an annular flange 23 of the hollow stem 19. In use the sliding fins 22 are guided by the vertical guides 11 of the retaining ring 9 during the stroke of the hollow stem. Moreover in the down-locked position (FIG. 1), the fins 22 of the hollow stem 19 are engaged by interference below the two down-locking undercuts 12 to maintain the hollow stem 19 in lowered position and the dispensing pump 1 shut.

The head 19*b* of the hollow stem 19 is tapered.

The hollow stem 19, preferably the head 19*b*, comprises at least one window 24, preferably two mutually opposite windows, to place selectively in fluid communication the channel 20 of the hollow stem 19 with the interior of the housing 2, in particular with the dosing chamber 8. The windows 24 are obtained on the lateral wall of the hollow stem 19 and the head 19*b* is axially closed, in such a way that the liquid in the dosing chamber 8 can enter the channel 20 of the hollow stem 19 only through the window 24.

The closed head of the hollow stem interacts with the shaped surface 18*c* of the inlet valve 18 when the hollow stem 19 pushes the inlet valve 18 down to ensure the sealing with the housing 2.

The head 19*b* of the hollow stem 19 comprises upper and lower abutments 25*a*, 25*b*.

The outer surface of the hollow stem 19 comprises a first (upper) conical surface 26*a* and a second (lower) conical surface 26*b* diminishing the diameter of the hollow stem from the upper portion to the head.

Figure 4:
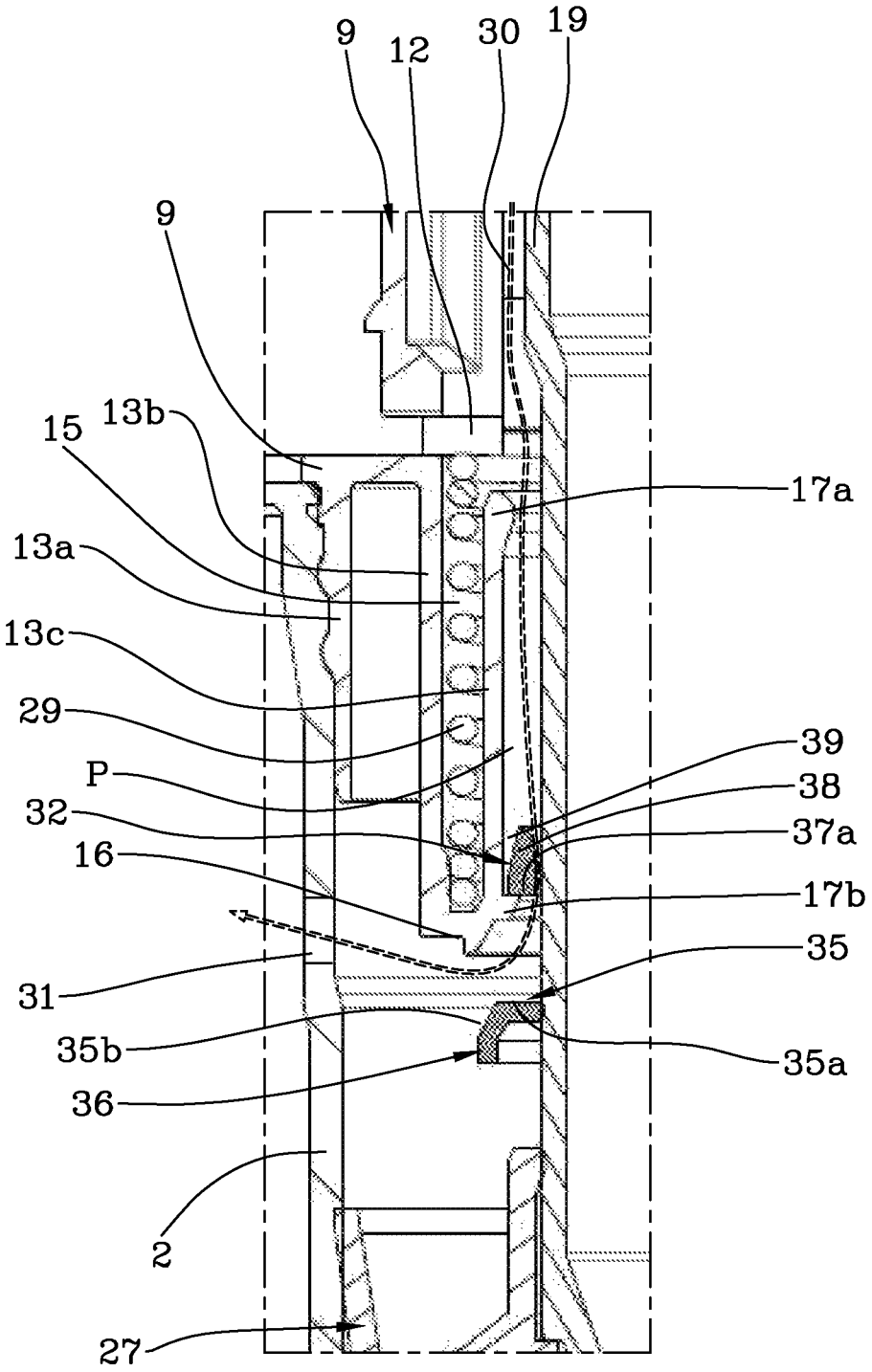
FIG. 4 is an enlarged view of a detail A of FIG. 3.

In use the hollow stem 19 slides axially within the hole 10 of the retaining ring 9, in particular within the inner skirt 13*c* leaving a passage P between the hollow stem 19 and the retaining ring 9. The passage P is in fluid communication with exterior by means for example the upper part of the retaining ring (FIG. 4).

The upper annular projection 17*a* of the inner skirt 13*c* is configured to touch the first conical surface 26*a* of the hollow stem 19 providing for a watertight seal when the hollow stem is in the down-locked position (FIG. 1).

The hollow stem 19 is associated inferiorly to a piston 27 and superiorly to the dispensing device to command the operation of the piston 27 and dispense the fluid contained in the bottle. The piston 27 is axially inserted on the head 19*b* of the hollow stem 19. In particular the tapered head 19*b* of the hollow stem 19 facilitates its assembly and coupling with the piston 27. More particularly the hollow stem 19 is inserted in a through hole 28 of the piston 27.

The piston 27 comprises two sealing zones 27*a* with the hollow stem 19.

The hollow stem 19 commands the operation of the piston 27, i.e. it actuates the piston 27 movable between a raised position (FIG. 2) and a lowered position (FIG. 1) within the dosing chamber 8.

The piston 27 comprises an outer surface able to contact the inner wall of the dosing chamber 8. The outer surface of the piston 27 slides within the dosing chamber 8 between the aforementioned raised position in which the volume of the dosing chamber is greatest, and the aforementioned lowered position, in which the volume of the dosing chamber 6 is smallest.

The stroke of the piston 27 is delimited superiorly by the position of interference between the piston 27 and the retaining ring 9 (FIG. 2) and inferiorly by the position of interference between the hollow stem 19 and the inlet valve 18 that opens and closes the orifice 6 of the housing 2.

The outer surface of the piston 27 slides providing fluid tightness along the inner wall of the housing 2, in such a way that the liquid present in the dosing chamber 8 cannot escape through the sliding coupling between piston 27 and dosing chamber 8.

The hollow stem 19 can slide relative to the piston 27 in such a way that the window 24 is occluded or cleared by the piston 27. Preferably, the relative motion between hollow stem 19 and piston 27 is delimited by upper and lower abutments 25*a*, 25*b* positioned on the hollow stem 19.

The piston 27 comprises a sealing seat 28*a* configured to receive the annular wall 18*d* of the inlet valve 18 when the hollow stem 19 is in its lowered position.

The dispensing pump 1 comprises elastic means 29, preferably a spring, to contrast the free sliding of the hollow stem 19 (and hence of the piston) within the housing 2. Preferably the spring is housed within the annular seat 15, between the intermediate skirt 13*b* and the inner skirt 13*c*. Therefore the retaining ring 9 contains the spring between two walls (intermediate skirt 13*b* and inner skirt 13*c*) keeping it separated from the liquid and preventing the liquid being in contact with it. Moreover the spring is housed within a seat defined superiorly by the annular flange 23 of the hollow stem 19 and inferiorly by the base 16 arranged between the intermediate skirt 13*b* and the inner skirt 13*c*.

The spring has the function to bring the hollow stem 19 and the piston 27 up in order to cause the suction phase in which the liquid is transferred from the bottle to the dosing chamber 8.

The dispensing pump 1 comprises a venting path 30 through which, during the pump actuation, a volume of air enters the bottle through a venting hole 31 of the housing 2 in order to replace the liquid pumped out from the bottle by the dispensing pump. In particular the venting path comprises the passage P between the hollow stem 19 and the retaining ring 9 and the venting hole 31 (FIG. 4).

A venting valve 32 is inserted on the retaining ring 9 and with the hollow stem 19, which slides into it during functioning. In particular the venting valve 32 is arranged at least partially inside the retaining ring 9 and outside the hollow stem 19, surrounding it. More particularly the venting valve 32 is interposed between the hollow stem 19 and the retaining ring 9, along the venting path 30.

The venting valve 32 can be displaced between a top/closing position and a bottom/opening position when the hollow stem and the piston travel their working stroke. When the hollow stem and the piston move towards their upper position, the valve is displaced to its top/closing position; when the hollow stem and the piston move downwardly, the valve is displaced in its bottom/opening position.

The venting valve 32 is a one-way valve. It allows only the flow from the external ambient to the bottle, so permitting the air return into the bottle, but avoids the possible leakage of the liquid contained into the package.

Figure 5:
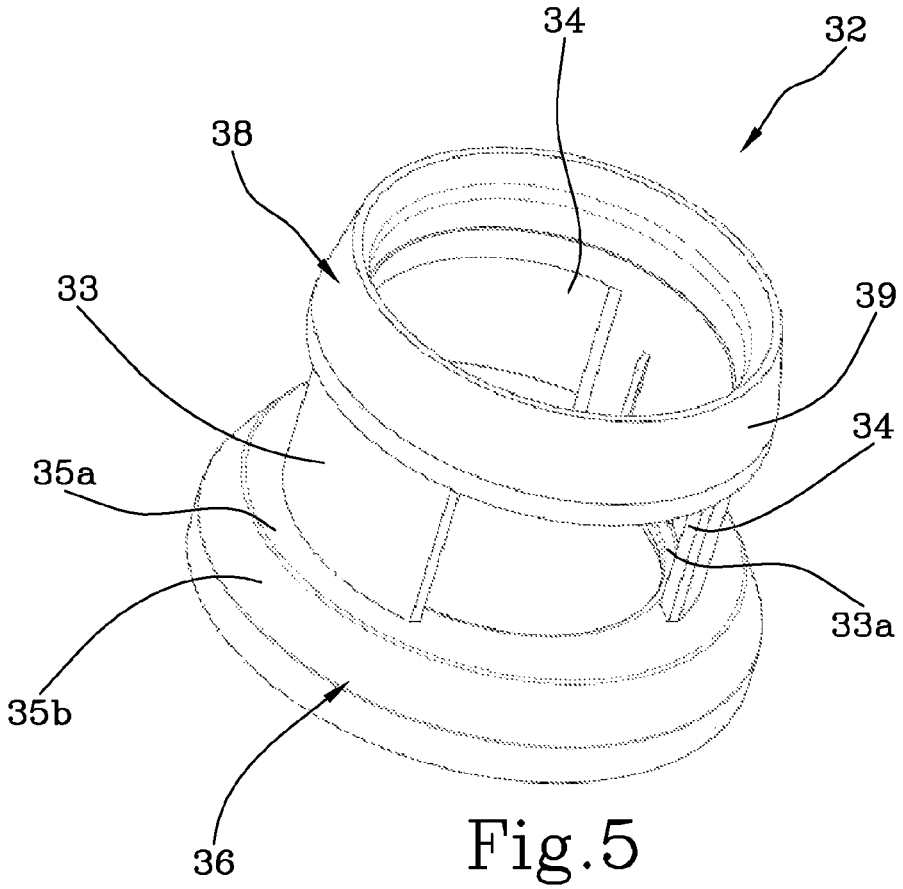
FIG. 5 is a perspective view of a component of the dispensing pump of FIG. 1.
Figure 6:
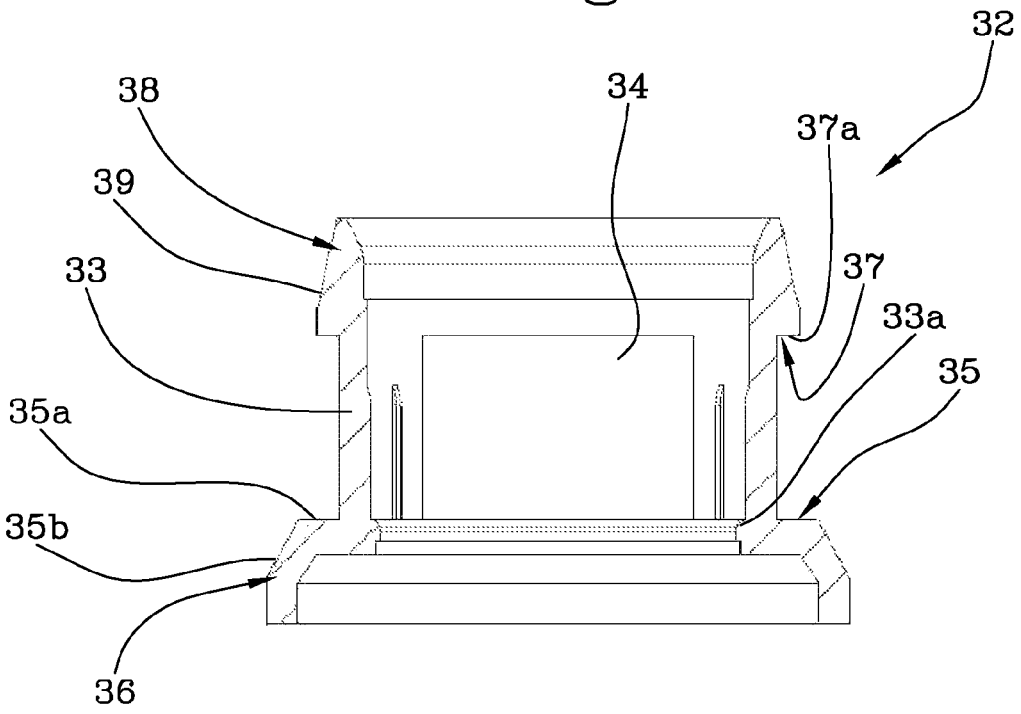
FIG. 6 is a sectioned view of the component of FIG. 5.

With reference to FIGS. 5-6, the venting valve 32 comprises a sleeve 33 that is associated to the hollow stem 19, around it, and that can slide on it. The sleeve 33 comprises a sealing ring 33*a* on the inner interface with the hollow stem 19. The sealing ring is arranged with interference on the inner interface with the hollow stem whereby the venting valve is dragged by the hollow stem during its stroke between the raised and lowered position.

Preferably the venting valve 32 is substantial axial symmetric.

When assembled, the sleeve 33 is arranged inside the lower annular projection 17*b* of the retaining ring 9 which project radially within the hole 10.

According to a possible embodiment the sleeve 33 comprises at least one cut 34 (preferably two mutually opposite cuts) to allow the passage of the air for venting.

According to a possible embodiment the venting valve 32 comprises a lower sealing surface 35 extending radially from the sleeve 33 and configured to close the venting path 30 in the top/closing position of the venting valve 32. In particular the lower sealing surface 35 is configured to create a seal with the retaining ring 9, in particular with the lower projection 17*b*, outside the retaining ring 9.

In particular the sealing ring 33*a* arranged with interference on an inner interface with the hollow stem 19 cooperates with the lower sealing surface 35 to close the passage P between the hollow stem 19 and the retaining ring 9. Preferably the sealing ring 33*a* corresponds to an inner radial projection of the lower sealing surface 35.

According to a possible embodiment the lower sealing surface 35 comprises a flat portion 35*a* configured to abut on the retaining ring 9 closing the passage P between the hollow stem 19 and the retaining ring 9. Preferably the lower sealing surface 35 further comprises a sloping portion 35*b* extending from the flat portion 35*a* and configured to abut on the conical seat 16*a* of the retaining ring 9.

In particular the lower sealing surface 35 and possibly the sealing ring 33*a* are arranged outside the retaining ring 9. Preferably the lower sealing surface 35 is configured to abut on the lower annular projection 17*b* of the retaining ring 9 which project radially within the hole 10.

Preferably the venting valve 32 comprises a lower ring portion 36 comprising the lower sealing surface 35. In particular the lower ring portion 36 has a cup configuration suitable for receiving a portion of the piston 27 in its raised position.

According to a possible embodiment the venting valve comprises an upper sealing surface 37 extending radially from the sleeve 33, opposite to the lower sealing surface 35. The upper sealing surface 37 is arranged inside the retaining ring 9 and is configured to abut internally on the lower annular projection 17*b* of the retaining ring 9.

Preferably the upper sealing surface 37 comprises a flat portion 37*a* configured to abut on the lower annular projection 17*b* of the retaining ring 9. When the upper sealing surface 37 abut on the retaining ring 9 a portion of the passage P between the venting valve 32 and the hollow stem 19 remains open.

According to a possible embodiment the venting valve 32 comprises an upper ring portion 38 comprising the upper sealing surface 37. Preferably the upper ring portion 38 comprises a conical sealing surface 39 configured to touch and to create a seal with the hollow stem 19, in particular with the second conical surface 26*b*, when the hollow stem is in the lowered position.

The lower sealing surface 35 and upper sealing surface 37 alternatively create a seal with the retaining ring 9.

In use the hollow stem and the piston travel their "working" stroke, to pump the liquid, between the raised position, delimited by the retaining ring, and the lowered position delimited by the inlet valve that selectively opens and closes the orifice of the housing, respectively during the suction/upward stroke and the pumping/downward stroke.

When the hollow stem is in its raised position, pressing on the dispensing device (actuator), the hollow stem starts the stroke downwardly and opens its window by sliding into the piston. Indeed in a first phase of the downwardly stroke, the piston remains motionless because of the friction of the wall of the piston with the wall of the dosing chamber. In other words in this phase the hollow stem translates relative to the piston facing the window situated at the lower end of the hollow stem.

Soon after the piston is dragged down by the hollow stem so it creates a compression inside the dosing chamber which closes firstly the inlet valve and then forces the liquid to flow through the window in the hollow stem, and through the channel of the hollow stem and the dispensing device until it flows out to the exterior. During this phase the spring is compressed in its seat.

As a result of the release of the dispensing device by the user, the entire system returns to the resting position thanks to the thrust of the spring. In particular the spring brings back the hollow stem at its raised position where the dosing chamber is filled again after the sucking phase.

During the rising phase, the hollow stem moves before the piston (held by the friction with the walls of the dosing chamber) thereby closing the window of the hollow stem. In this way, the liquid present in the hollow stem is prevented from being aspirated into the dosing chamber again.

The translation during the return stroke of the piston in the dosing chamber creates a depression inside the dosing chamber which determines the aspiration of liquid through the dip tube and the orifice of the housing. The liquid fills the dosing chamber.

The return stroke ends when the piston is blocked by the limit imposed by the retaining ring.

At each dispensing operation, a volume of air equal to the dispensed liquid enters the bottle through the passage P that develops partially between the hollow stem and the retaining ring and partially within the housing (FIG. 4). The passage P is placed in fluid communication with the venting hole drilled on the housing and facing the interior of the bottle.

When the dispensing pump is in lock position (FIG. 1) the venting valve seals both with the hollow stem and the retaining ring, ensuring a safer sealing together with the principal sealing point, represented by the coupling between the upper annular projection 17*a* of the inner skirt 13*c* and the first conical surface 26*a* of the hollow stem 19. In particular the upper sealing surface 37 creates a seal with the lower annular projection 17*b* of the retaining ring 9 and the conical sealing surface 39 creates a seal with the hollow stem 19, in particular with the second conical surface 26*b*.

To unlock the dispensing pump a 90° counter clockwise turn of the hollow stem is needed. Once the dispensing pump is opened, the spring pushes the hollow stem upwardly. In lock-down dispensing pumps the volume above the piston could be filled by the liquid through the venting hole. The venting valve prevents the liquid to go upon the hollow stem and go out of the dispensing pump when the dispensing pump is opened. When the hollow stem begins its upper stroke, the friction present between the hollow stem and the venting valve drags the valve up until it stops against the retaining ring, closing all the passage to the fluid through outside, constraining it to flow back into the bottle through the venting hole 31. For this reason the venting hole has such dimensions to allow an easy discharge of the liquid inside this volume.

In particular the venting valve is in interference with the hollow stem by means of the sealing ring 33*a*. Moreover the sealing ring 33*a* ensures also the sealing between the hollow stem and the valve.

As soon as the stem starts moving upward, the lower sealing surface 35 seals on the retaining ring 9 and prevents the liquid to go out during all the up stroke. The hollow stem 19 can slide through the venting valve 32 because the interference is just enough to prevent the passage of the liquid. In other words the venting valve acts as a scraper ring on the hollow stem. At the end of the stroke, the piston stops against the retaining ring 9 abutting on the venting valve 32 and ends the stroke.

Figure 3:
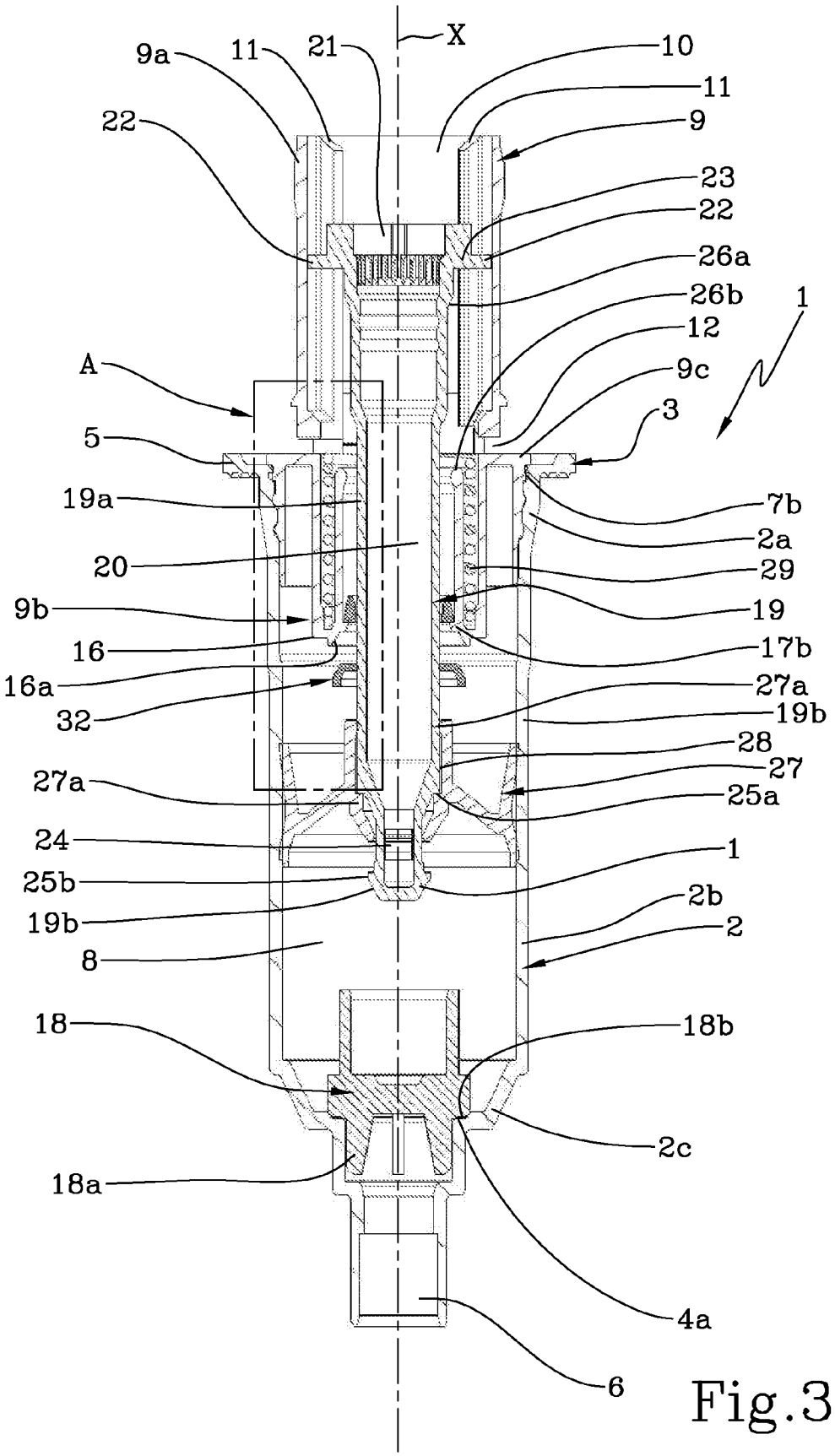
FIG. 3 shows the dispensing pump of FIG. 1 in an intermediate configuration during a descending phase.

During the actuation (downwardly stroke) the venting valve 32 is dragged down by the hollow stem until the upper sealing surface 37 touches the lower annular projection 17*b* (FIG. 3) preventing further lowering of the venting valve. The downwardly stroke of the venting valve opens the passage to the air so that the bottle is refilled for the compensation. In particular the air is free to enter into the bottle through the space present between the venting valve and the hollow stem (FIG. 4) and through the cuts 34.

The invention achieves the proposed object by means of the venting valve 32 which prevents the liquid to go upon the hollow stem and go out of the dispensing pump when the dispensing pump is opened. Moreover the venting valve 32 acts during normal use, no added gestures are needed, and it is assembled internally during the normal assembly process, free to float on the retaining ring.

The dispensing pump with the venting valve can be used the same way the known dispensing pumps are used.

What is claimed is:

1. A dispensing pump comprising:

a housing extending along a longitudinal axis and configured to be inserted in a bottle, the housing defining a dosing chamber and comprises a venting hole;

a retaining ring fastened to the housing and inserted therein;

a hollow stem associated to a piston and inserted in a hole of the retaining ring leaving a passage, the hollow stem and the piston being movable between a lowered position and a raised position corresponding to different volumes of the dosing chamber;

a venting path through which, during pump actuation, a volume of air enters the bottle through the venting hole to replace the liquid pumped out from the bottle by the dispensing pump, the venting path comprising at least the passage between the hollow stem and the retaining ring and the venting hole; and a venting valve interposed between the hollow stem and the retaining ring, along the venting path, the venting valve being configured to allow only the flow from the external ambient to the bottle, permitting the air return into the bottle, and configured to avoid leakage of the liquid, the venting valve comprising a sleeve surrounding the hollow stem, the sleeve comprising a sealing ring disposed with interference on an inner interface with the hollow stem whereby the venting valve is dragged by the hollow stem during its stroke between the raised and lowered position.

2. The dispensing pump according to claim 1, wherein the venting valve surrounds the hollow stem that slides inside the venting valve, and the venting valve being configured to be displaced between a top/closing position and a bottom/opening position following the stroke of the hollow stem whereby when the hollow stem moves towards the raised position, the venting valve is displaced to the top/closing position and when the hollow stem moves downwardly towards the lowered position, the venting valve is displaced in the bottom/opening position.

3. The dispensing pump according to claim 1, wherein the sleeve is disposed inside a lower annular projection of the retaining ring which projects radially within the hole.

4. The dispensing pump according to claim 3, wherein the sleeve comprises at least one cut to allow the passage of the air for venting.

5. The dispensing pump according to claim 4, wherein the venting valve comprises a lower sealing surface extending radially from the sleeve and configured to close the venting path in the top/closing position of the venting valve.

6. The dispensing pump according to claim 5, wherein the sealing ring disposed with interference on an inner interface with the hollow stem cooperates with the lower sealing surface to close the passage between the hollow stem and the retaining ring.

7. The dispensing pump according to claim 6, wherein the sealing ring with interference on an inner interface with the hollow stem corresponds to an inner radial projection of the lower sealing surface.

8. The dispensing pump according to claim 5, wherein the lower sealing surface comprises a flat portion configured to abut on the retaining ring closing the passage between the hollow stem and the retaining ring.

9. The dispensing pump according to claim 8, wherein the lower sealing surface comprises a sloping portion extending from the flat portion and configured to abut on a conical seat of the retaining ring.

10. The dispensing pump according to claim 5, wherein the lower sealing surface and the sealing ring disposed with interference on an inner interface with the hollow stem are arranged outside the retaining ring, the lower sealing surface being configured to abut on the lower annular projection of the retaining ring which project radially within the hole.

11. The dispensing pump according to claim 5, wherein the venting valve comprises a lower ring portion comprising the lower sealing surface.

12. The dispensing pump according to claim 11, wherein the lower ring portion has a cup configuration configured to receive a portion of the piston in the raised position.

13. The dispensing pump according to claim 5, wherein the venting valve comprises an upper sealing surface extending radially from the sleeve, opposite to the lower sealing surface, the upper sealing surface being disposed inside the retaining ring and being configured to abut internally on the lower annular projection of the retaining ring.

14. The dispensing pump according to claim 13, wherein the upper sealing surface comprises a flat portion configured to abut on the retaining ring without closing the passage between the hollow stem and the retaining ring.

15. The dispensing pump according to claim 13, wherein the venting valve comprises an upper ring portion comprising the upper sealing surface.

16. The dispensing pump according to claim 15, wherein the upper ring portion comprises a conical sealing surface configured to touch a second conical surface of the hollow stem in the lowered position of the hollow stem.

* * * * *